US010060256B2

(12) United States Patent
Halfmann et al.

(10) Patent No.: US 10,060,256 B2
(45) Date of Patent: Aug. 28, 2018

(54) COMMUNICATION SYSTEM FOR SEQUENTIAL LINER HANGER SETTING, RELEASE FROM A RUNNING TOOL AND SETTING A LINER TOP PACKER

(71) Applicant: BAKER HUGHES INCORPORATED, Houston, TX (US)

(72) Inventors: Eric Halfmann, Magnolia, TX (US); Ammar A. Munshi, Sugar Land, TX (US); Keven O'Connor, Houston, TX (US); Basil J. Palakapilly, Sugar Land, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 261 days.

(21) Appl. No.: 14/943,838

(22) Filed: Nov. 17, 2015

(65) Prior Publication Data

US 2017/0138183 A1 May 18, 2017

(51) Int. Cl.

| | |
|---|---|
| ***E21B 47/14*** | (2006.01) |
| ***E21B 33/12*** | (2006.01) |
| ***E21B 43/10*** | (2006.01) |
| ***E21B 47/18*** | (2012.01) |
| ***E21B 47/06*** | (2012.01) |

(52) U.S. Cl.

CPC ..... *E21B 47/14* (2013.01); *E21B 33/12* (2013.01); *E21B 43/10* (2013.01); *E21B 47/18* (2013.01); *E21B 47/06* (2013.01)

(58) Field of Classification Search

CPC ..... E21B 47/14; E21B 33/12; E21B 43/10; E21B 47/18; E21B 47/06; E21B 23/06; E21B 23/00; E21B 47/12

See application file for complete search history.

(56) References Cited

U.S. PATENT DOCUMENTS

| | | | | |
|---|---|---|---|---|
| 5,279,363 | A * | 1/1994 | Schultz | E21B 34/066 166/264 |
| 5,355,960 | A | 10/1994 | Schultz et al. | |
| 5,579,283 | A | 11/1996 | Owens et al. | |
| 5,706,896 | A | 1/1998 | Tubel et al. | |
| 5,721,538 | A | 2/1998 | Tubel et al. | |

(Continued)

FOREIGN PATENT DOCUMENTS

| | | | |
|---|---|---|---|
| WO | 2014184586 | A2 | 11/2014 |
| WO | 2015135548 | A1 | 9/2015 |

*Primary Examiner* — Wei Wang

(74) *Attorney, Agent, or Firm* — Steve Rosenblatt

(57) ABSTRACT

A communication system for sequential operation of subterranean tools involves flow based signals that are picked up with an acoustic receiver at a master controller, which then signals one or more slave controllers that operate tools and communicate back to the master controller that the subject tool has been operated. Sensors associated with the control system gather data downloaded when the master controller is pulled out of the hole. The system can be used to set a liner hanger and release a running tool and communicate that the liner hanger and running tool has activated. This can be confirmed with setting down weight and noting the running string going from tension to compression with a load cell or by translating the running string within the hole. The liner top packer can be set with a flow based signal to the master controller which is then removed with the running string.

20 Claims, 1 Drawing Sheet

(56) References Cited

U.S. PATENT DOCUMENTS

| | | | | |
|---|---|---|---|---|
| 6,021,095 | A | 2/2000 | Tubel et al. | |
| 6,533,040 | B2 | 3/2003 | Gondouin | |
| 6,624,759 | B2 | 9/2003 | Tubel et al. | |
| 7,108,073 | B2 | 9/2006 | Patel | |
| 7,503,398 | B2 | 3/2009 | Logiudice et al. | |
| 7,967,071 | B2 | 6/2011 | Brown | |
| 8,286,717 | B2 | 10/2012 | Giroux et al. | |
| 8,517,113 | B2 | 8/2013 | Sheffield | |
| 8,567,515 | B2 | 10/2013 | Giroux et al. | |
| 8,733,448 | B2 | 5/2014 | Skinner et al. | |
| 8,783,343 | B2 | 7/2014 | Giroux et al. | |
| 9,004,195 | B2 | 4/2015 | Regener et al. | |
| 9,027,650 | B2 | 5/2015 | Radford et al. | |
| 9,051,810 | B1 | 6/2015 | Cuffe et al. | |
| 2009/0146835 | A1 | 6/2009 | Xu et al. | |
| 2011/0168403 | A1 | 7/2011 | Patel | |
| 2014/0008083 | A1* | 1/2014 | Ring | E21B 23/06 166/382 |

* cited by examiner

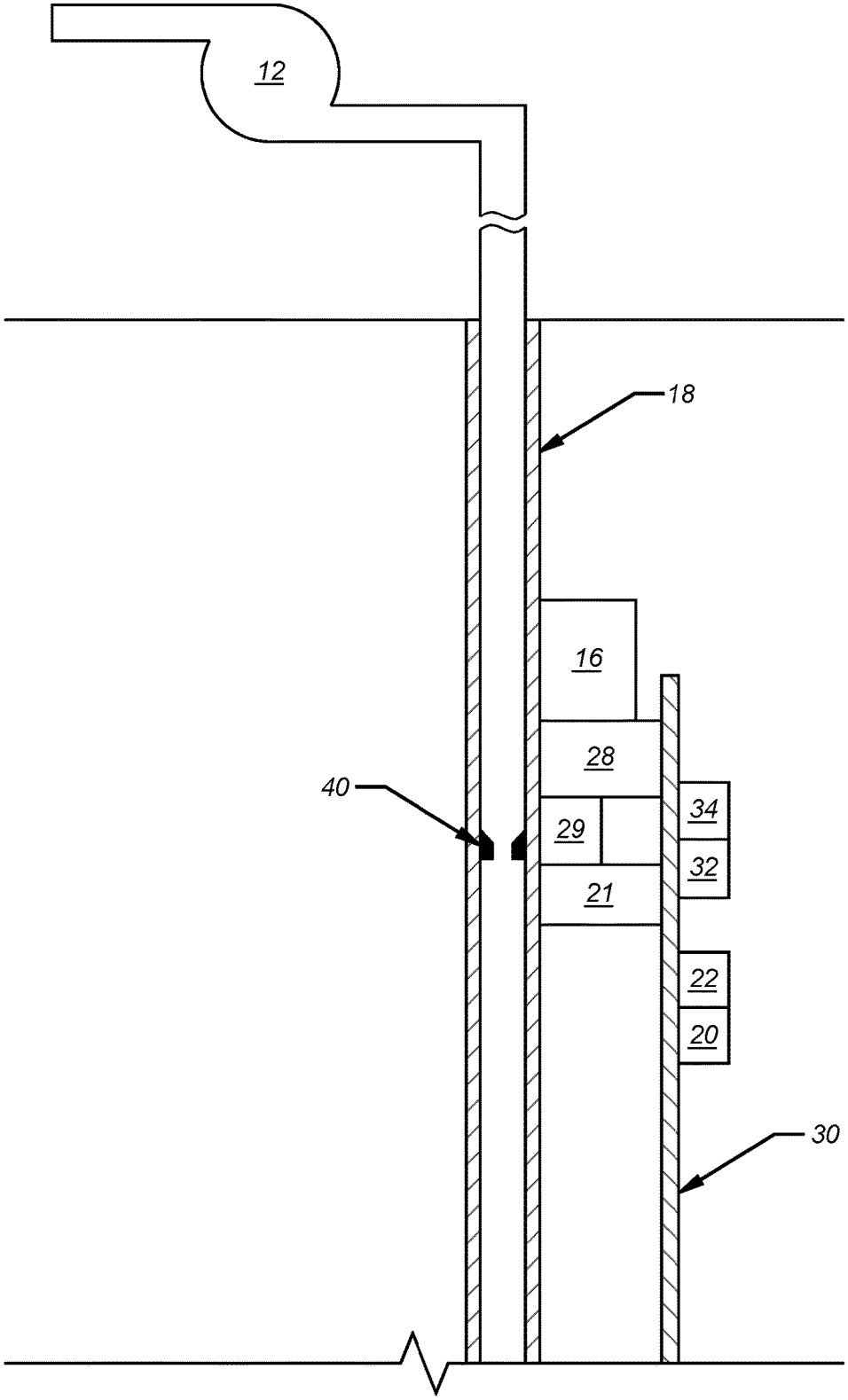
12
18
16
28
40
29
34
32
21
22
20
30

COMMUNICATION SYSTEM FOR SEQUENTIAL LINER HANGER SETTING, RELEASE FROM A RUNNING TOOL AND SETTING A LINER TOP PACKER

FIELD OF THE INVENTION

The field of the invention is subterranean control systems for operation of tools in a sequence and more particularly systems that use acoustic transmitters and receivers to communicate between a master controller and associated slave controllers.

BACKGROUND OF THE INVENTION

Completing a well frequently involves delivery of a liner string to be supported from an existing tubular. Typically, the liner string is delivered on a running string so that a liner hanger on the liner string is brought into position adjacent a lower end of an existing string in the borehole. The liner hanger is set and after it is determined that the liner string is supported the running tool is released from the liner. Cement can then be pumped through the liner through a cement shoe at the bottom of the liner with annulus fluids displaced upwards through gaps in the now set liner hanger. After the cementing is completed the liner top packer is set sealing the annulus between the liner and the existing tubular.

The setting of the liner hanger and subsequently the liner top packer has typically been done with pumping balls onto seats and building up pressure against a seated ball. This technique takes a long time and a faster way of actuating such tools sequentially is needed. Also, complications may arise from physically landing pumped balls onto seats or from pressuring up; thus a quicker and more reliable method of actuating such tools is needed.

The concept of setting liner hangers without balls or darts is shown in US 2014/0008083. Paragraph 48 of this reference also recites release of the setting tool using the acoustic signal technique. Various other references teach setting liner hangers with signals from the surface to the hanger or other tools such as U.S. Pat. No. 5,579,283; WO 2014184586 A2; U.S. Pat. No. 6,533,040 (electromagnetic); U.S. Pat. No. 8,286,717 and related U.S. Pat. No. 8,783,343; U.S. Pat. No. 9,004,195; U.S. Pat. No. 6,021,095 (acoustic) and U.S. Pat. No. 8,567,515 (column 13 line 45). U.S. Pat. No. 9,051,810 shows introducing the transmitter into the tubular to activate a valve to open. What is needed and provided by the present invention is a fast and reliable way to coordinate subterranean tool operation using flow based signals picked up by an acoustic receiver in a master controller that then wirelessly commands nearby slave controllers to actuate equipment and signal back that such equipment has been operated. The master controller can also include sensors for measuring well conditions and tool status and storing the information for downloading after the controller comes out of the hole. The measured information can also be used by the master controller to make autonomous decisions and initiate subsequent conditional actions by the slaves. These and other aspects of the present invention will be more readily apparent to those skilled in the art from a review of the detailed description of the preferred embodiment and the associated drawing while recognizing that the full scope of the invention is to be determined by the appended claims.

SUMMARY OF THE INVENTION

A communication system for sequential operation of subterranean tools involves flow based signals that are picked up with an acoustic receiver at a master controller, which then signals one or more slave controllers that operate tools and communicate back to the master controller that the subject tool has been operated. Sensors for well conditions and tool status are associated with the control system to gather data that can then be downloaded when the master controller is pulled out of the hole. The system can be used to set a liner hanger and release a running tool and communicate that the liner hanger or running tool has activated. This can be confirmed with setting down weight and noting the running string going from tension to compression with a load cell. The liner top packer can be set with a subsequent flow based signal to the master controller which is then removed with the running string. The master controller can also have preprogrammed intelligence to act upon data gathered about the well and the tool to initiate slave actions without needing command signals from the surface. The master controller may also have the facility to communicate with the surface through flow, pressure or acoustic signals.

BRIEF DESCRIPTION OF THE DRAWING

The FIGURE is a schematic representation of the control system for a liner hanger and associated liner top packer.

DETAILED DESCRIPTION OF THE PREFERRED EMBODIMENT

Referring to the FIGURE a pump 12 is provided whose operation in varying the pumped flow rates creates a signal picked up by an acoustic receiver 14 in the master controller 16 that is associated with a running string 18. The master controller 16 recognizes a flow pattern from pump 12 and processes that signal so that a command signal goes out to slave controller 20. The command signal is transferred from the running string to the liner string via the signal transmitting device 21. In the preferred embodiment the slave controller 20 commands a liner hanger and associated actuator 22 to set for support of the liner string 24 from a surrounding tubular that is not shown. Slave controller 20 has the capacity to signal back to the master controller 16 that the liner hanger has been set. The setting of the liner hanger 22 can be confirmed at the surface by setting down weight on the running string 18. A load cell 26 can detect the change from tension in the running string to compression from setting down weight after the liner hanger 22 is in a gripping relationship with a surrounding tubular that is not shown. Alternatively, the master controller 16 can send signals to the surface, such as acoustically, to confirm that the liner hanger 22 is set or/and that the running string 18 is in compression rather than tension. Once the master controller 16 has the signal that the running string 18 is in compression and that the liner hanger 22 has been actuated, a command signal from the master controller 16 goes out to the running tool slave 29 associated with the liner string 30 to release the running tool 28 from the liner string 30. Alternatively a flow pattern from pump 12 to master controller 16 could be used to initiate the command to running tool slave 29. If cementing is to take place, it occurs next.

If no cementing is contemplated, the master controller 16 after picking up a flow induced signal with an acoustic receiver 14, sends a signal to another slave controller 32 that communicates with a liner top packer and an associated actuator 34 to trigger setting the packer 34. Slave controller 32 then communicates with master controller 16 that the packer 34 is set. The master controller 16 communicates with the surface that the packer 34 is set and the running string 18 is pulled out of the hole with the master controller 16. Data collected in the master controller 16 including data from any sensors measuring well conditions that have communicated such information to the master controller 16 as well as all communication between the master controller 16 and any slave controllers such as 20 or 32 can then be downloaded.

In an alternative to using acoustic receivers, a ball can be dropped on seat 40 and pressure signals can be sent to the master controller 16 to be picked up by pressure sensors placed in the master. The signals between the master controller 16 and the slave controllers such as 20 and 32 can be acoustic or electromagnetic as the transmission distance is very short and a wireless communication method facilitates removal of the master controller 16 with the running string 18.

While a sequential method of tool operation is illustrated in the context of a liner hanger and liner top packer, those skilled in the art will appreciate that other tools can be sequentially operated with signals sent from the surface in the form of variable flow that are sensed with an acoustic receiver in a master controller that then gives commands and receives acknowledgement from slave controllers, preferably with acoustic or other wireless signals and then either stores the information in the master controller or communicates to the surface through wired or wireless systems. If the information is stored in the master controller, such information can be accessed when the master controller is removed from the borehole.

The above description is illustrative of the preferred embodiment and many modifications may be made by those skilled in the art without departing from the invention whose scope is to be determined from the literal and equivalent scope of the claims below:

We claim:

1. A subterranean method for sequential operation of multiple tools, comprising:

sending a flow signal to a master controller;

receiving said flow signal with a receiver at said master controller;

generating a command signal to at least one slave controller associated with an actuator for a liner hanger;

operating said liner hanger with said actuator for said liner hanger.

2. The method of claim 1, comprising:

sending said flow signal from a surface location.

3. The method of claim 1, comprising:

sending an acknowledgement signal to said master controller from said slave controller after said operating.

4. The method of claim 1, comprising:

communicating between said master controller and slave controller with at least one of acoustic, electromagnetic, pressure, flow and wireless signals.

5. The method of claim 1, comprising:

delivering said master controller with a tubular string;

removing said master controller with said tubular string after said operating.

6. The method of claim 1, comprising:

communicating confirmation of said operating from said master controller to a surface location when said master controller is in a borehole.

7. The method of claim 1, comprising:

providing, as said at least one slave controller, a plurality of slave controllers, each slave controller associated with a respective actuator for selective operation of a plurality of associated tools;

sequentially operating said actuators with different signals sensed by said receiver at said master controller.

8. The method of claim 1, comprising:

sending another flow signal, detected by the downhole master controller, which initiates recording of downhole parameters of at least one of pressure, temperature, tension, compression, torque; and later retrieving data after pulling out the master controller.

9. The method of claim 1, comprising:

providing, as said at least one slave controller, a plurality of slave controllers each slave controller selectively operating an associated actuator for sequential operation of said liner hanger and a liner packer;

providing intelligence to said master controller such that said sending a flow signal to the master controller triggers sequential commands from said master controller to said slave controllers for sequential operation of said liner hanger and said liner packer.

10. A subterranean method for sequential operation of multiple tools, comprising:

sending a flow signal to a master controller;

receiving said flow signal with a receiver at said master controller;

generating a command signal to at least one slave controller associated with an actuator for a first tool;

operating said first tool with said actuator for said first tool;

providing, as said at least one slave controller, a plurality of slave controllers, each slave controller associated with a respective actuator for selective operation of a plurality of associated tools;

sequentially operating said actuators with different signals sensed by said receiver at said master controller;

connecting a first of said slave controllers to a liner hanger;

setting the liner hanger with a command from said master controller to said first slave controller;

connecting a second of said slave controllers to a running tool and releasing said running tool after setting said liner hanger.

11. The method of claim 10, comprising:

receiving a flow signal at said receiver for said master controller unique for setting said liner hanger;

sending a signal to said first slave controller for setting said liner hanger;

setting down weight on a running string for a liner string after setting said liner hanger;

sensing on a load cell said running string going from a tensile to a compressive condition;

performing said releasing the running tool after said sensing.

12. The method of claim 11, comprising:

communicating a reading on said load cell to a surface location.

13. The method of claim 10, comprising:

supporting said running tool on a running string;

setting down weight on said running string after setting said liner hanger;

detecting support at the surface from said set liner hanger;

releasing said running tool from said liner string.

14. The method of claim 10, comprising:

connecting a third slave controller to a liner top packer;

receiving a flow signal at said receiver of said master controller;

commanding said third slave controller with said master controller to set said liner top packer.

15. The method of claim 14, comprising:

confirming to said master controller from said third slave controller that said liner top packer is set.

16. The method of claim 15, comprising:

using acoustic or electromagnetic signals to perform said confirming.

17. The method of claim 10, comprising:

confirming to said master controller from said first slave controller that said liner hanger is set.

18. The method of claim 17, comprising:

using acoustic or electromagnetic signals for said confirming.

19. A subterranean method for sequential operation of multiple tools, comprising:

sending a flow signal to a master controller;

receiving said flow signal with a receiver at said master controller;

generating a command signal to at least one slave controller associated with an actuator for a first tool;

operating said first tool with said actuator for said first tool;

providing at least one pressure sensor with a running string supporting said master controller;

providing a ball seat in said running string;

delivering a ball to said ball seat to create pressure signals sensed by said pressure sensor for communication to said master controller from a remote location.

20. A subterranean method for sequential operation of multiple tools, comprising:

sending a flow signal to a master controller;

receiving said flow signal with a receiver at said master controller;

generating a command signal to at least one slave controller associated with an actuator for a first tool;

operating said first tool with said actuator for said first tool;

providing, as said at least one slave controller, a plurality of slave controllers each slave controller selectively operating an associated actuator for sequential operation of discrete tools;

providing intelligence to said master controller such that said sending a flow signal to the master controller triggers sequential commands from said master controller to said slave controllers for sequential operation of the discrete tools associating said slave controllers with a liner hanger, a running tool for a liner string and a liner string packer;

sequentially operating said liner hanger and then said running tool and finally said liner string packer based on said sending a flow signal to the master controller.

* * * * *